US009793605B1

(12) United States Patent
Desclos et al.

(10) Patent No.: US 9,793,605 B1
(45) Date of Patent: Oct. 17, 2017

(54) MODAL ANTENNA ARRAY FOR INTERFERENCE MITIGATION

(71) Applicant: Ethertronics, Inc., San Diego, CA (US)

(72) Inventors: Laurent Desclos, San Diego, CA (US); Jeffrey Shamblin, San Marcos, CA (US); Lynn Chiu, San Diego, CA (US); Abhishek Singh, San DIego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 14/728,828

(22) Filed: Jun. 2, 2015

Related U.S. Application Data

(60) Provisional application No. 62/006,687, filed on Jun. 2, 2014.

(51) Int. Cl.
*H01Q 3/24* (2006.01)
*H01Q 3/26* (2006.01)

(52) U.S. Cl.
CPC ..... *H01Q 3/24* (2013.01); *H01Q 3/247* (2013.01); *H01Q 3/26* (2013.01); *H01Q 3/2605* (2013.01)

(58) Field of Classification Search
CPC H01Q 3/24; H01Q 3/26; H01Q 3/247; H01Q 3/2605
USPC ..... 343/876, 893
See application file for complete search history.

(56) References Cited

U.S. PATENT DOCUMENTS 8,279,132 B2 * 10/2012 Jung ..... H01Q 1/246 343/853
8,885,750 B2 * 11/2014 Xiao ..... H04B 7/024 375/267
2008/0037669 A1 * 2/2008 Pan ..... H04B 7/0417 375/260

* cited by examiner

*Primary Examiner* — Brian Young
(74) *Attorney, Agent, or Firm* — Coastal Patent Law Group, P.C.

(57) ABSTRACT

A modal antenna array is described where modal antenna elements capable of generating multiple radiation modes are used to form array radiation patterns. Nulls in the array radiation pattern can be formed and positioned by proper modal antenna element mode selection, with these nulls used to provide interference suppression or mitigation. The shift in array radiation pattern maxima generated by modal element mode selection can be used to improve communication system link quality by optimizing array radiation pattern characteristics. Specifically, a ring or circular array configuration is described where a simplified common feed port can be implemented to feed multiple modal antenna elements used to form the array. A switch can be used to connect or disconnect one modal element from the array, with this feature providing additional unique array beam states. The modal array can be commanded via a look-up table or algorithm.

11 Claims, 9 Drawing Sheets

$$G \propto \frac{G_{fs}}{nD_1} \times \sin\left(\frac{D_1}{\lambda} + \Theta_{Mn}\right)$$

$G_{fs}$ = antenna gain in free space $\Theta_{Mn}$ = Modal antenna reference phase

MODAL ANTENNA ARRAY FOR INTERFERENCE MITIGATION

CROSS-REFERENCE TO RELATED APPLICATIONS

This application claims benefit of priority with U.S. Provisional Ser. No. 62/006,687, filed Jun. 2, 2014; the contents of which are hereby incorporated by reference.

BACKGROUND

Field of the Invention

This invention relates generally to the field of wireless communication; and more specifically, to communication networks and antenna array techniques for interference suppression and multipath mitigation.

Description of the Related Art

Cellular networks and WLANs (Wireless Local Area Networks) are prevalent in society and have evolved to a level that moderate to high data rate transmissions along with voice communications are stable and reliable over large regions and throughout urban areas. Mobile user devices have progressed to point of providing not only voice communications and low data rate text and email service but also high data rate internet connectivity. Continued adoption of mobile communications systems and introduction of new uses of cellular networks such as Machine to Machine (M2M) applications have put strain on the cellular systems in regard to providing consistent service and improved service in terms of higher data rates and less service interruptions from one year to the next. Similar congestion can be found on wireless local area network (WLAN) networks where a large number of users are putting strain on these systems. Continued improvements are sought after to improve communication system reliability as well as better command and control of communication nodes and the mobile devices utilizing these nodes.

SUMMARY OF THE INVENTION

A modal antenna array is described wherein a plurality of modal antenna elements, each capable of generating multiple radiation modes, are used to form array radiation patterns. Nulls in the array radiation pattern can be formed and positioned by proper modal antenna element mode selection, with these nulls used to provide interference suppression or mitigation. The shift in array radiation pattern maxima generated by modal element mode selection can be used to improve communication system link quality by optimizing array radiation pattern characteristics. Specifically, a ring or circular array configuration is described where a simplified common feed port can be implemented to feed multiple modal antenna elements used to form the array. A switch can be used to connect or disconnect one modal element from the array, with this feature providing additional unique array beam states. The modal array can be commanded via a look-up table or algorithm.

DESCRIPTION OF EMBODIMENTS

Figure 1A:
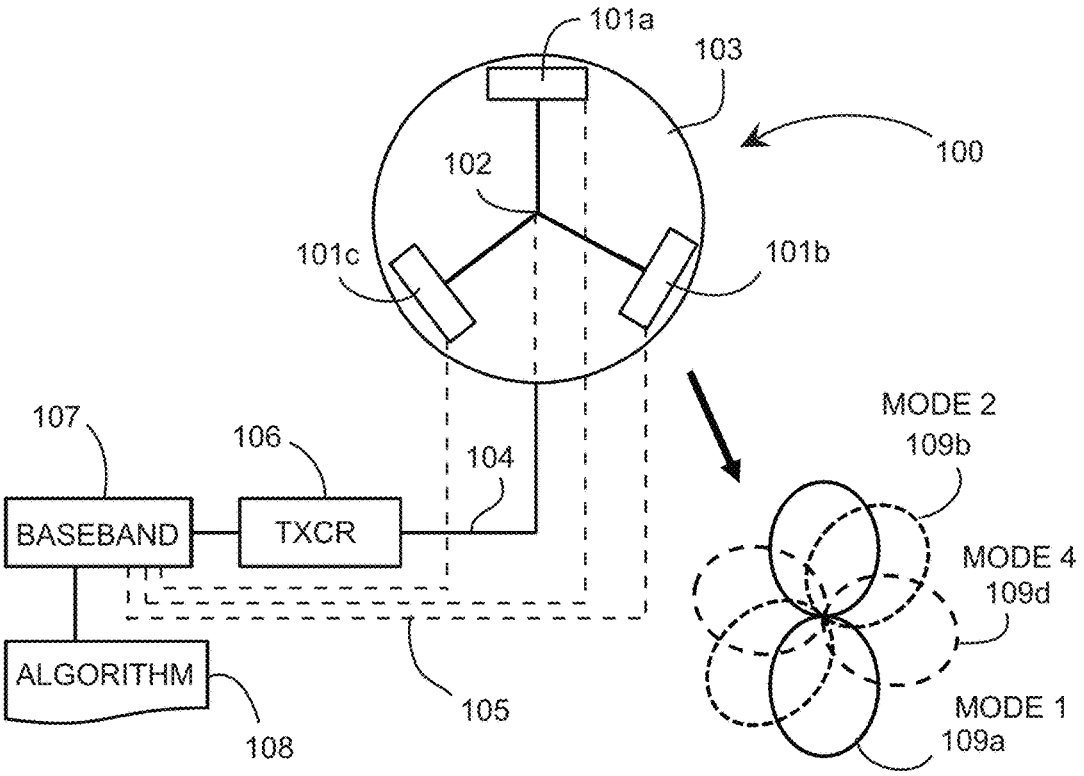
FIG. 1A shows a three element circular antenna array formed with three Modal antennas positioned radially from a feed point, each Modal antenna being positioned about equal distance from one another, the array connected to a transceiver and baseband for supplying radiofrequency (RF) and control signals.

The following invention describes an antenna array technique that provides better interference and multipath mitigation for communication systems operating in multipath environments and/or in regions where there are large numbers of communication devices operating. The result of implementing this antenna array technique is reduced interference from adjacent mobile communication devices and reduced adverse effects from multipath, with the benefits being higher data rate communication and reduced interruption of service.

An antenna system comprises an array of Modal antennas, with the array typically formed in a circular fashion. A Modal antenna is a single port antenna system capable of generating multiple radiation modes, wherein the radiation modes are de-correlated when compared to each other. Arraying multiple Modal antennas together can result in an array that has a substantially larger number of individual beam states compared to a traditional antenna array formed from single radiation mode antenna elements. The multiple radiation patterns generated by the Modal antenna elements can be used to form a plurality of different array radiation patterns. The Modal antennas can be used to form and control the location of nulls in the array radiation pattern. The nulls can be positioned to provide interference suppression from RF interferers. Additionally, the nulls can be positioned to minimize the amount of power received at the array from reflectors in the propagation path such as walls or other structures or objects. Alternately, a mode can be selected that phases the reflected signal from a reflector with the direct signal to maximize received or transmitted power to or from the Modal array.

One embodiment of this invention is an array comprised of three Modal antennas, with the Modal antennas positioned on a circle. A single feed point is positioned in the center of the circle and three transmission lines extend from the common feed point to the three Modal antennas, one transmission line per antenna. Each Modal antenna is configured to generate four unique radiation patterns, with a switch or set of switches used to change the radiation pattern of the Modal antenna. A set of control signals are provided to each of the Modal antennas from a look-up table resident in memory. A total of 34 radiation patterns can be generated from this three element Modal array.

In another embodiment of this invention an algorithm is provided with the Modal array, wherein the algorithm accesses one or multiple metrics from a baseband processor or other processor and uses these metrics to make array beam steering decisions. The metric used for this purpose can be CQI (Channel Quality Indicator), RSSI (Receive Signal Strength Indicator), BER (Bit Error Rate), data rate, or other metrics that provide information regarding the propagation channel and/or communication system performance. The processor can be the baseband processor, application processor, or other processor resident in the communication system or connected to the communication system. The algorithm will provide control signal settings to the Modal antennas to alter the array radiation pattern.

In another embodiment of this invention the algorithm can be configured to specifically determine Modal antenna array beam states that reduce interference in the communication system connected to the Modal antenna array from sources such as communication systems or other sources of RF transmission in the field of view of the Modal antenna array. The multiple radiation patterns of the Modal antenna array are generated and sampled to determine the best radiation pattern that provides a good communication link with the intended transceiver and reduces interference from un-desired RF sources.

In another embodiment of this invention the algorithm can be configured to reduce multipath from specific scatterers in the propagation channel. The multiple radiation patterns of the Modal antenna array are generated and sampled to determine the best radiation pattern that produces a null in the direction of the angle of arrival of a multipath source. An algorithm can be configured to work with a signal processing routine which transforms frequency domain data from swept frequency response of the propagation channel and transforms to the time domain utilizing FFTs (Fast Fourier Transform) or DFTs (Discrete Fourier Transform), with the FFTs or DFTs providing a multipath profile of the channel wherein a single scattering source can be identified for suppression. The Modal antenna array beam state can be selected that suppresses the multipath source.

In another embodiment of the invention a Modal antenna array configured with two Modal antennas or four or more Modal antennas is implemented. The two Modal antenna array configuration provides for a simplified array assembly, while the Modal antenna array wherein four or more Modal antennas are used provides for a larger number radiation beam states and finer control over radiation pattern null positioning. Nm beam states can be provided from a Modal antenna array, where N is the number of Modal antenna elements used in the array and m is the number of modes generated by each Modal antenna element.

In another embodiment of the present invention, a number of modes generated by each Modal antenna in the array is less than or greater than four. A larger number of modes can be generated to provide a larger number of radiation patterns, which can provide more fine control over the null locations. To minimize complexity, one or multiple antennas in a Modal array can have a large number of modes while other Modal antennas in the array can have fewer modes. The larger number of modes can be generated by using a tunable capacitor with 16 or more tuning states to vary the impedance loading of the offset parasitic used to change the radiation pattern of the antenna. In addition to varying the number of modes per Modal antenna in the array configuration, Modal arrays can be configured to contain a mix of Modal antennas and traditional antennas. A traditional antenna is described here as an antenna that has a single, fixed radiation pattern. Combining Modal antenna elements and traditional antenna elements allows for a Modal array wherein nulls can be formed and null locations dynamically shifted, with the traditional elements providing the capability of reducing array beamwidth while managing complexity of the array.

In yet another embodiment of the present invention one or multiple switches are used to connect or disconnect one or multiple transmissions lines leading to one or multiple Modal antenna elements in a Modal antenna array. For example, for a three Modal antenna element array configuration, one switch is integrated into one transmission line used to connect one Modal antenna element to the common feed point of the Modal antenna array. The switch can be used to connect or disconnect the Modal antenna from the array, which when disconnected results in a two element Modal antenna array. By disconnecting one Modal antenna the resultant radiation pattern beamwidths, gains, and null locations of the Modal antenna array will change compared to the three element array. This switching technique can be implemented to produce a larger number of available beam states from the array as well as provide additional variation in null locations.

Figure 1B:
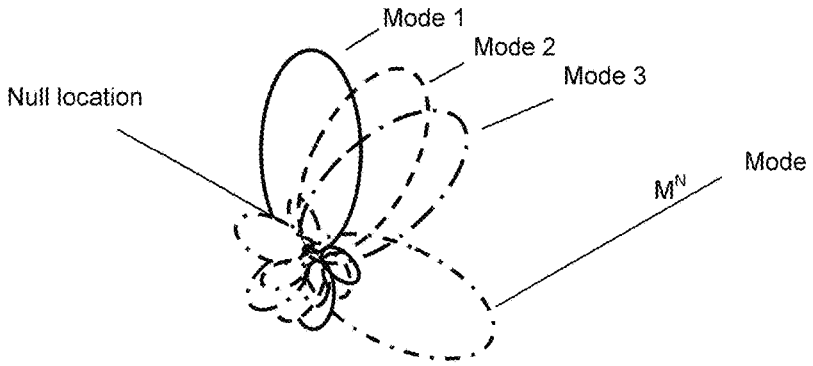
FIG. 1B shows $3^4$ unique radiation modes for the three-element array with each Modal antenna having four modes associated therewith.

FIGS. 1(A-B) illustrate a three element circular array derived from three Modal antennas 101*a*; 101*b*; 101*c*. Each Modal antenna is capable of generating four unique radiation patterns (109*a*-109*d*). The three Modal antennas are connected to a common feed point 102 and positioned over a ground plane 103. A transceiver 106 is connected to the common feed point of the array via an RF transmission line 104, and a baseband processor 107 is configured with an algorithm 108. The baseband processor provides control signals 105 for the Modal antennas to select the radiation mode. The radiation patterns generated by the array 100 are shown in FIG. 1B. The three element array of Modal antennas, with each Modal antenna configured for producing four distinct radiation pattern modes, is thus adapted to generate $3^4$ unique radiation pattern modes of the array.

Figure 2:
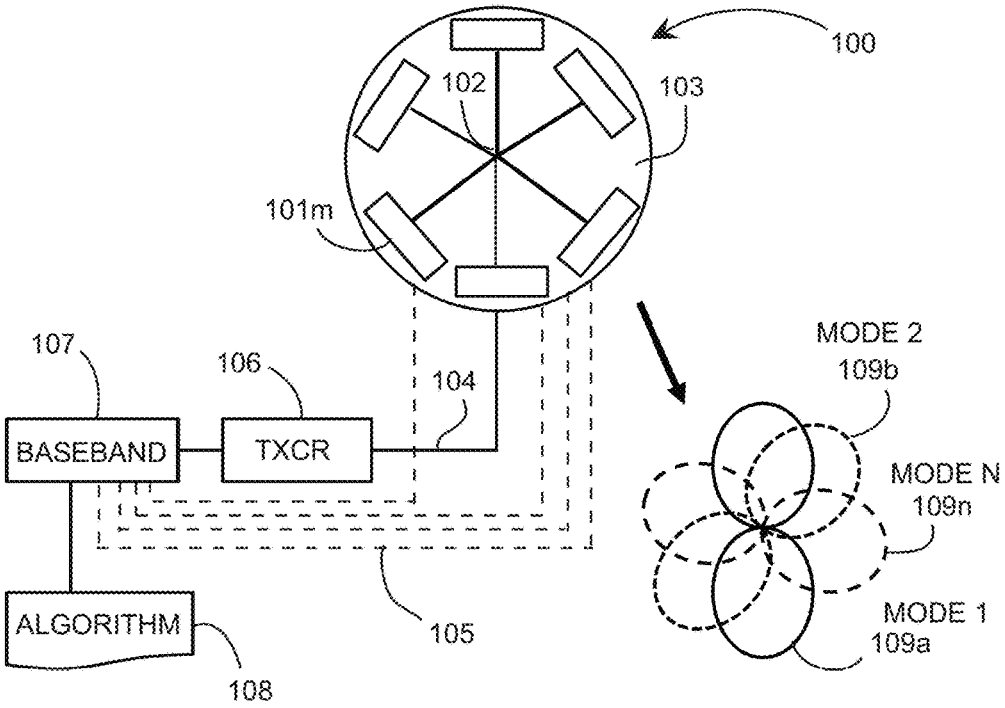
FIG. 2 shows an M-element circular array having M Modal antennas, wherein M is an integer.

FIG. 2 illustrates an M element circular array derived from M Modal antennas 101*m*. Each Modal antenna is capable of generating four unique radiation patterns (109*a*-109*n*). The M Modal antennas 101*m* are connected to a common feed point 102 and positioned over a ground plane 103. A transceiver 106 is connected to the common feed point of the array via an RF transmission line 104, and a baseband processor 107 is configured with an algorithm 108. The baseband processor provides control signals 105 for the Modal antennas to select the radiation mode. The radiation patterns (109*a*-109*n*) generated by the array 100 are shown. The "M" element array, with each Modal antenna thereof configured to produce "n" distinct radiation pattern modes, is configured to produce "M^n" unique radiation pattern modes of the array.

Figure 3A:
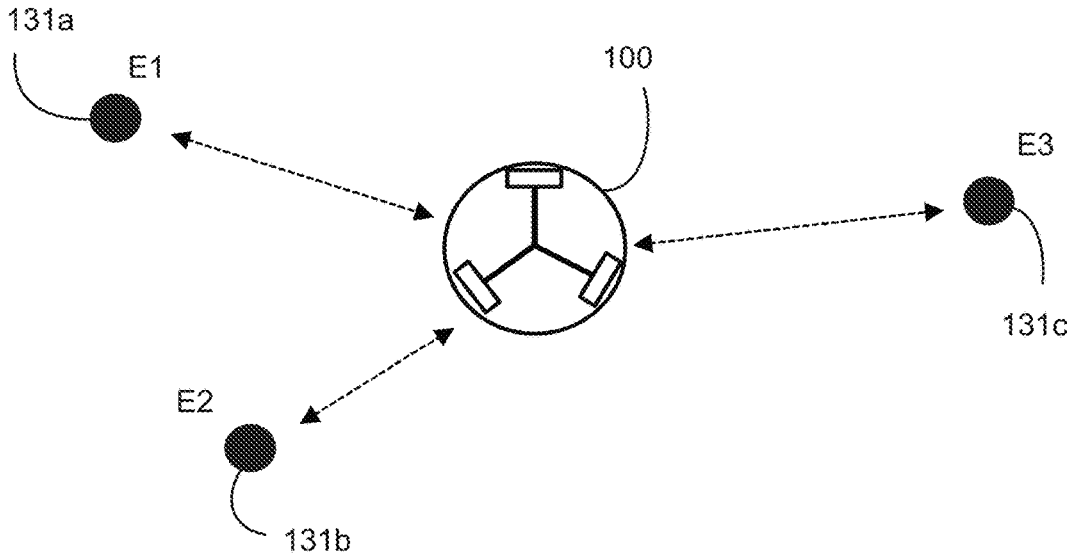
FIG. 3A shows a Modal array and three communication systems labeled E1, E2, and E3.
Figure 3B:
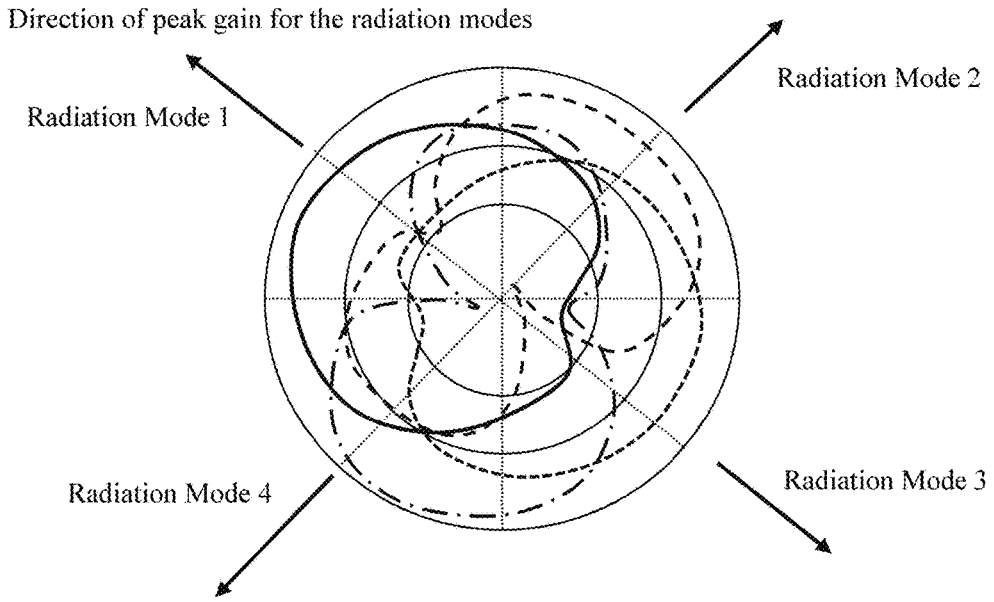
FIG. 3B shows the Modal antenna array of FIG. 3A is configured to generate multiple radiation pattern modes to provide coverage over a 3D volume.

FIGS. 3(A-B) illustrate a Modal array 100 and three communication systems 131*a*; 131*b*; 131*c* labeled E1, E2, and E3. The four radiation modes generated by the Modal array are shown in FIG. 3B. The Modal array provides multiple radiation pattern modes which can be generated to provide radiation pattern coverage over a three dimensional volume.

Figure 4A:
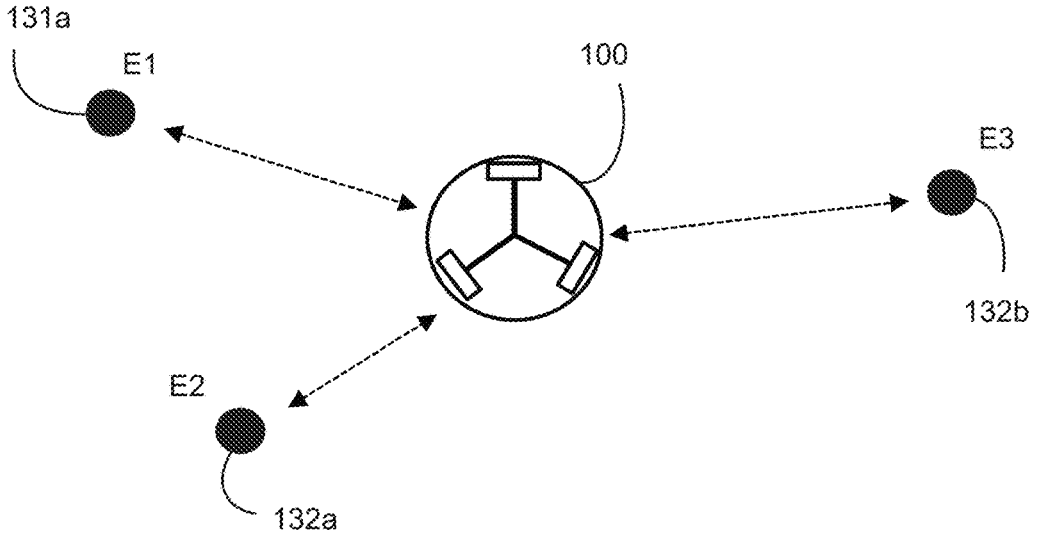
FIG. 4A shows a Modal array and three communication systems labeled E1, E2, and E3.
Figure 4B:
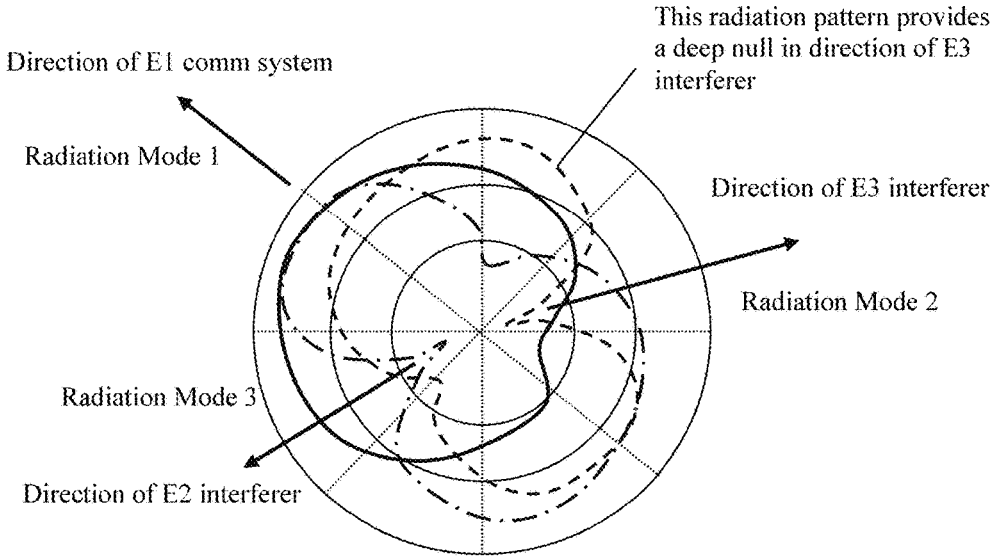
FIG. 4B shows the Modal antenna array of FIG. 4A is configured to generate multiple radiation pattern nulls in the direction of interferers.

FIGS. 4(A-B) illustrate a Modal array 100 and three communication systems 131*a*; 132*a*; 132*b* labeled E1, E2, and E3. Communication between the Modal array and E1 (131*a*) is desired, and interfering signals are received at the Modal array from E2 and E3. Three radiation modes generated by the Modal array are shown in FIG. 4B, with the direction of E1, E2, and E3 shown in relation to the radiation patterns. A radiation pattern from the Modal array can be chosen to provide antenna gain in the direction of E1, and provide reduced antenna gain in directions of E2 and E3. Radiation pattern nulls are provided in the direction of the interferers.

Figure 5A:
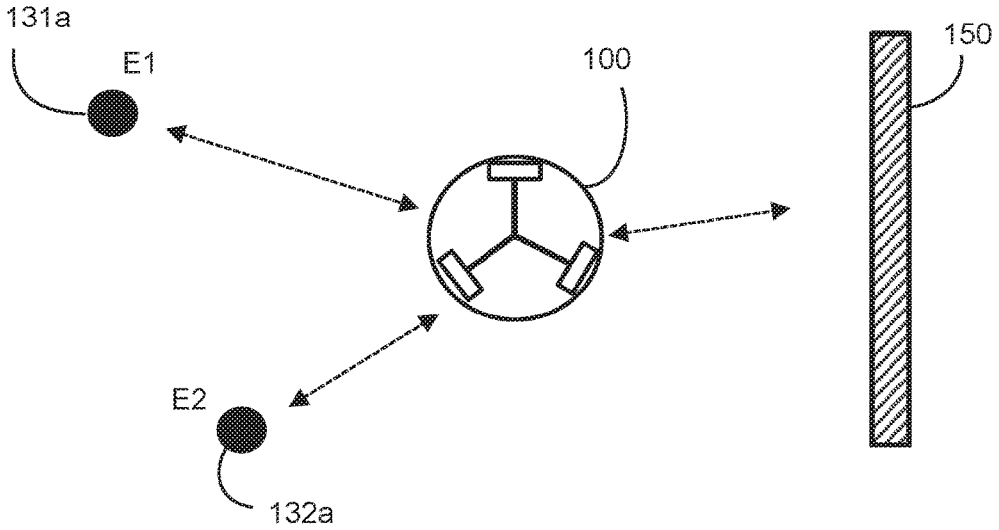
FIG. 5A shows a Modal array and two communication systems labeled E1 and E2 adjacent to an obstruction.
Figure 5B:
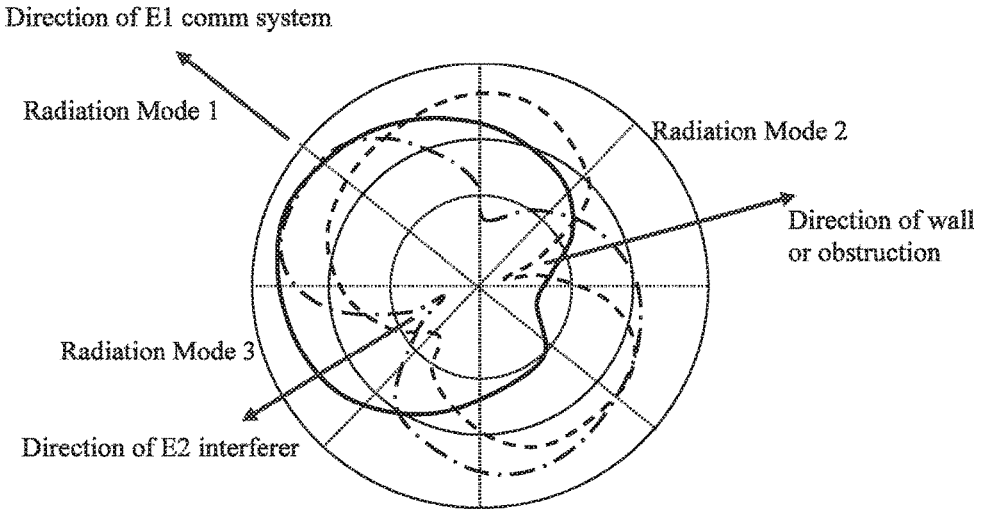
FIG. 5B shows the Modal antenna array of FIG. 5A is configured to generate multiple radiation pattern modes for providing an optimal radiation pattern for a specific multipath environment.

FIGS. 5(A-B) illustrate a Modal array 100 and two communication systems labeled E1 (131*a*) and E2 (132*a*). A wall or obstruction 150 is located in the vicinity of the Modal array. Communication between the Modal array and E1 is desired, and an interfering signal is received at the Modal array from E2. Three radiation modes generated by the Modal array are shown, with the direction of E1, E2, and E3 shown in relation to the radiation patterns. A radiation pattern from the Modal array can be chosen to provide antenna gain in the direction of E1, and provide reduced antenna gain in directions of E2 and the wall or obstruction.

Figure 6A:
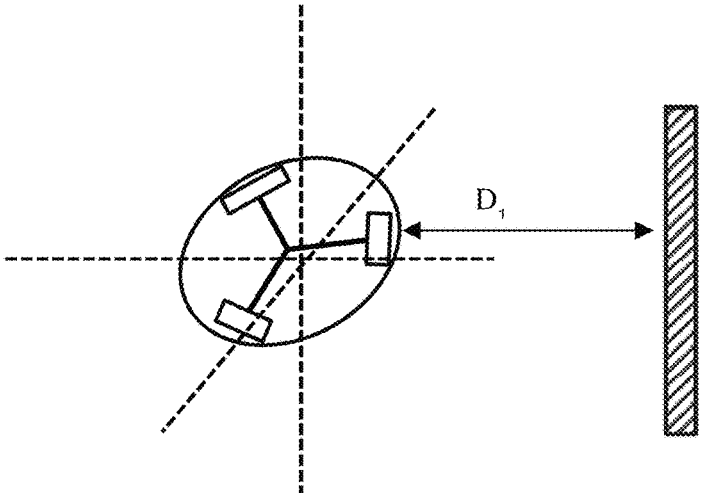
FIG. 6A shows a three element Modal antenna array positioned at a distance D1 from a wall.
Figure 6B:
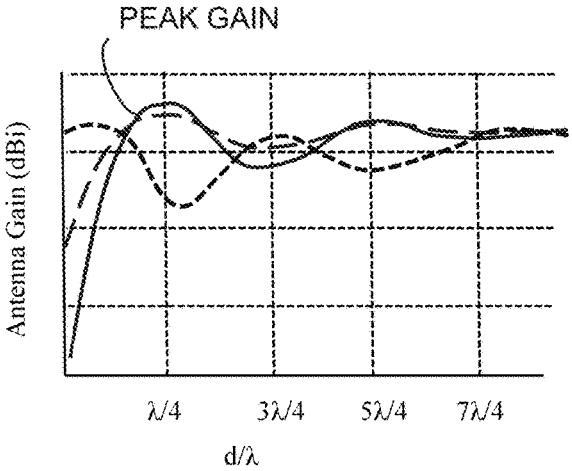
FIG. 6B shows peak gain of the Modal antenna array of FIG. 6A in a direction opposing the obstruction for three distinct modes.

FIGS. 6(A-B) illustrate a three element Modal array positioned at a distance D1 from a wall. A plot of antenna gain for three radiation modes of the Modal array as a function of distance is shown in FIG. 6B. The radiation modes of the Modal antenna elements used to populate the Modal array can be varied to provide a maxima or minima in the direction of the wall, and the reflected signal from the wall back into the array can be minimized or maximized depending on the amplitude and phase properties of the radiation modes. A radiation mode can be chosen to optimize the received power received at the Modal array when in the vicinity of the wall. Peak gain of the Modal antenna array in a direction opposing the obstruction is shown for three modes. A change in amplitude and phase from the Modal array provides differing achievable gains as a function of the array spacing from the obstruction.

Figure 7A:
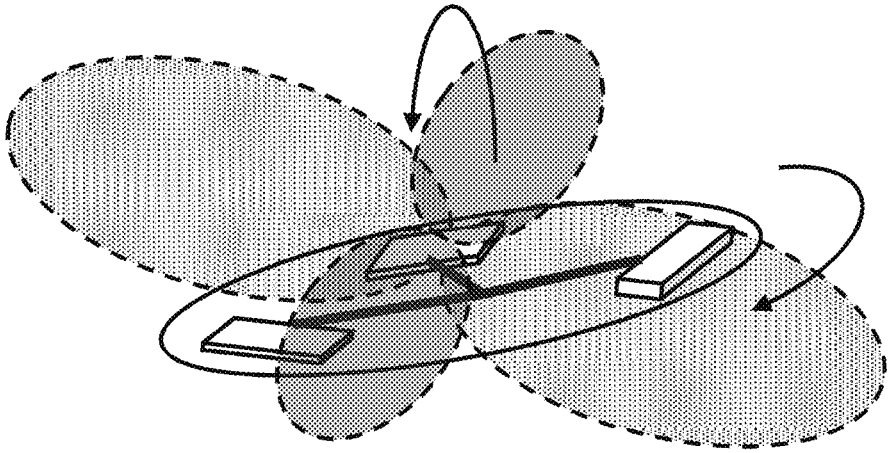
FIG. 7A shows a Modal antenna array and the radiation patterns including nulls generated in two of the three principal planes.
Figure 7B:
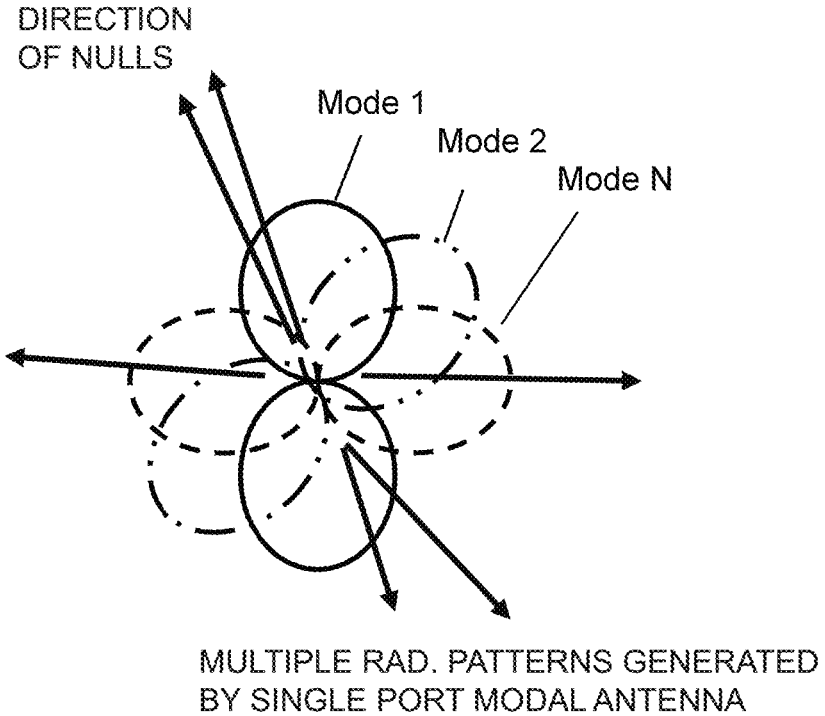
FIG. 7B shows the direction of nulls and multiple radiation patterns generated by a single feed port modal antenna.

FIGS. 7(A-B) illustrate a Modal array and shows the radiation patterns generated in two of the three principal planes. This illustration highlights the fact that a Modal array can generate nulls in the array pattern in three dimensions, as shown in FIG. 7B.

Figure 8:
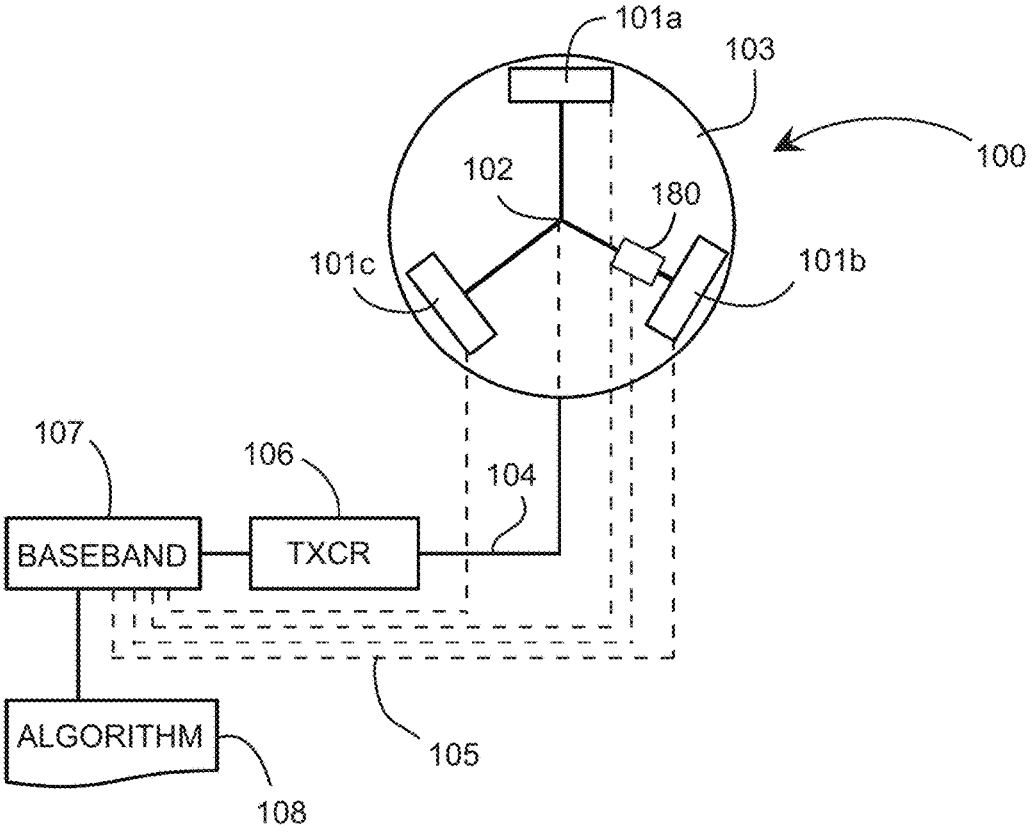
FIG. 8 shows a three element circular array derived from three Modal antennas, with one of the Modal antennas being connected to the array through a switch.

FIG. 8 illustrates a three element circular array derived from three Modal antennas 101*a*; 101*b*; 101*c*. Each Modal antenna is capable of generating four unique radiation patterns. The three Modal antennas are connected to a common feed point 102 and extend above a ground plane 103. A switch 180 has been integrated into the feed line between the feed point and one of the Modal antenna elements 101*b*. A transceiver 106 is connected to the common feed point of the array 100 and a baseband processor 107 is configured with an algorithm 108. The baseband processor provides control signals 105 for the Modal antennas to select the radiation mode. The addition of the switch results in additional radiation patterns that can be generated from the array. The radiation patterns generated by the array include $3^4+2^4$ unique radiation pattern modes for three element array of Modal antennas, with four modes and a switch integrated into one transmission line to connect or disconnect one Modal antenna from the array.

Figure 9:
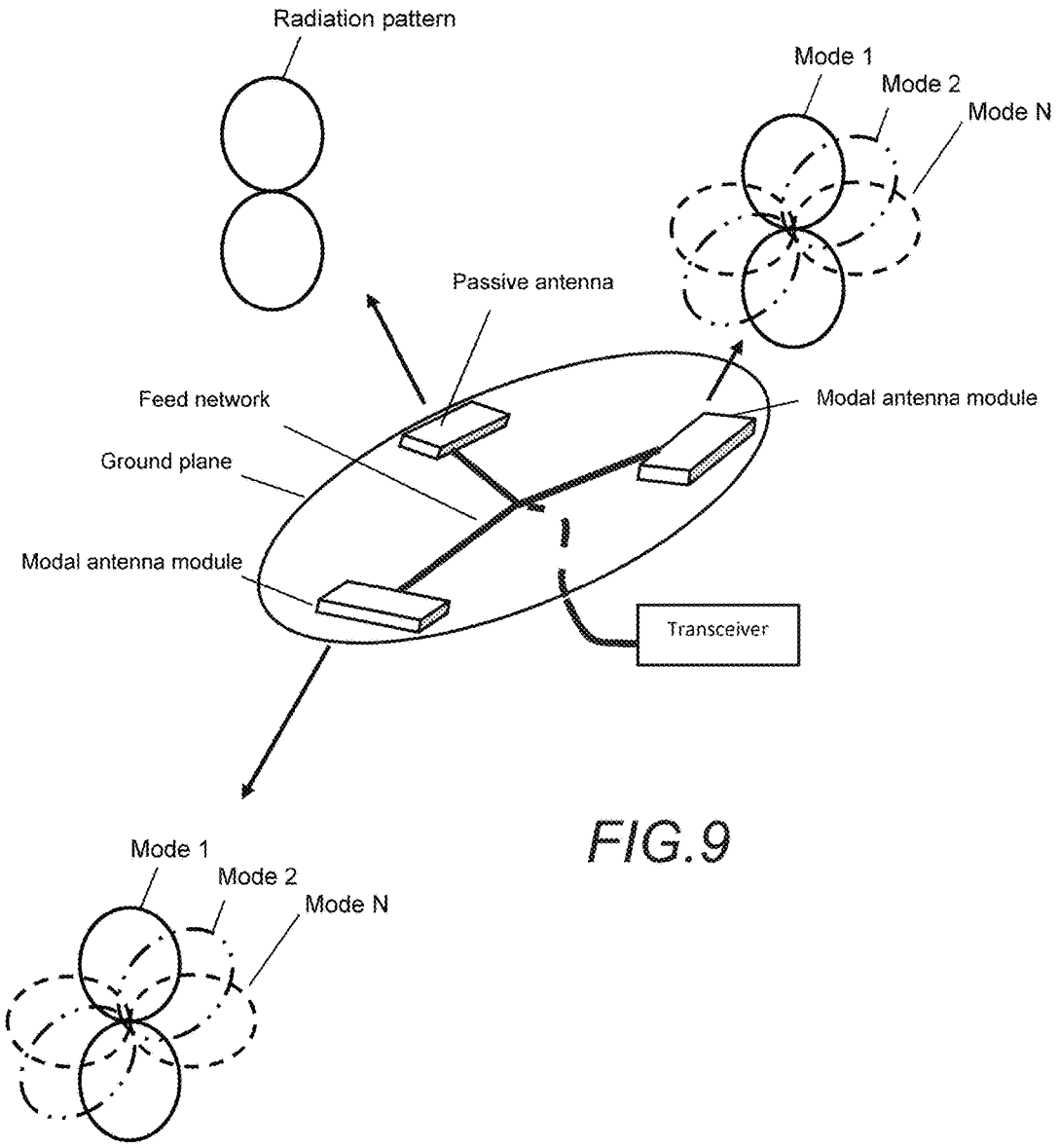
FIG. 9 shows a Modal antenna array where one of the three antenna elements used to configure the array is a passive antenna, with the remaining two antenna elements being comprised of Modal antenna elements, the Modal antenna elements including multiple radiation pattern modes.

FIG. 9 illustrates a Modal array where one of the three antenna elements used to configure the array is a passive antenna, with the remaining two antenna elements being comprised of Modal antenna elements. Multiple radiation patterns are generated by a single port Modal antenna.

The invention claimed is:

1. A modal antenna array comprising:

a plurality of antenna elements, with the antenna array comprising two or more modal antenna elements, each modal antenna being selectively configurable in one of two or more radiation modes; a common feed point directly connected to the modal antenna elements in the array, with a plurality of transmission lines, each transmission line connecting one of the antenna elements in the array to the common feed point; and an algorithm resident in a processor;

wherein the algorithm is configured to implement a radiation mode selection process to optimize a radiation pattern of the modal array and to establish one or more communication links with one or multiple more communication devices.

2. The modal antenna array of claim 1, wherein at least one of the antenna elements does not comprise a modal antenna.

3. The modal antenna array of claim 1, wherein a switch is connected to a first of the transmission lines that is used to provide a signal from the common feed point to a first modal antenna element of the plurality of antenna elements, the switch being configured to connect or disconnect the first modal antenna element from the array.

4. The modal antenna array of claim 3 wherein two or more switches are connected to two or more transmission lines used to provide a signal from the common feed point to two or more modal antenna elements, each switch is used to connect or disconnect the respective modal antenna element from the modal array.

5. A modal antenna array comprising:

a plurality of antenna elements, with the antenna array comprising two or more modal antenna elements, each modal antenna being selectively configurable in one of two or more radiation modes; a common feed point directly connected to the modal antenna elements in the array, with a plurality of transmission lines, each transmission line connecting one of the antenna elements in the array to the common feed point; and a look-up table, the look-up table is populated with multiple beam states that can be generated by the modal antenna array, the look-up table being configured to provide control signal information that is used to select the radiation mode of the modal antenna elements populating the modal array to establish one or more communication links with one or multiple more communication devices.

6. A modal antenna array comprising:

a plurality of antenna elements, with the antenna elements comprising one or more modal antennas, each modal antenna being selectively configurable in one of two or more radiation modes;

a common feed point associated with the modal antenna array, with a plurality of transmission lines, each transmission line connecting one of the antenna elements in the array to the common feed point; and an algorithm resident in a processor;

wherein the radiation modes of the array are separated into pre-dominantly vertical polarization and pre-dominantly horizontal polarization groups, radiation modes of the array that are pre-dominantly vertical polarization can be sampled and used, or radiation modes of the array that are pre-dominantly horizontal polarization can be sampled and used, or a mix of modes from the two groups can be sampled and used, the algorithm is configured to implement a radiation mode selection process to optimize a radiation pattern of the modal array and to establish one or multiple communication links with one or multiple communication devices.

7. A communication system comprising: a modal antenna array, the modal antenna array comprising:

a plurality of antenna elements, with the antenna elements comprising one or more modal antennas, each modal antenna being selectively configurable in one of two or more radiation modes; a transceiver connected to the antenna array;

a processor which provides control signals to said antenna array; and an algorithm resident in said processor;

wherein the communication system is positioned in a location where communication with one or more other wireless systems is to be performed, with the one or more other wireless systems comprising a second end of a communication link and the communication system comprising a first end of the communication link, wherein software which has been loaded into the processor of one or more other wireless system or systems is used to measure a communication link metric as the radiation modes are switched on the antenna array of the communication system, for determining one or multiple survey points in the location where communication is to be performed, the survey points being arranged at different locations and/or with different orientations or configurations for the wireless systems, the radiation mode performance at the survey points having been collected is used by the algorithm to provide optimal communication link performance between the communication system and one or multiple more wireless devices.

8. The communication system of claim 7, at least one of the antenna elements does not comprise a modal antenna.

9. The communication system of claim 7, the modal antenna array further comprising: a common feed point associated with the modal antenna array, with a plurality of transmission lines, each transmission line connecting one of the antenna elements in the array to the common feed point.

10. The communication system of claim 9, wherein a switch is connected to a first transmission line that is configured to provide a signal from the common feed point to the first modal antenna element, wherein the switch is adapted to connect or disconnect the first modal antenna element from the array.

11. The communication system of claim 10 wherein a switch is connected to a transmission line that is used to provide a signal from the common feed point to one non-modal antenna element.

* * * * *